US005248237A

United States Patent [19]

Nakamura

[11] Patent Number: 5,248,237

[45] Date of Patent: Sep. 28, 1993

[54] FRAME STRUCTURE OF A WORKING VEHICLE FOR ATTACHING A WORKING IMPLEMENT

[75] Inventor: Kentaro Nakamura, Sakai, Japan

[73] Assignee: Kubota Corporation, Osaka, Japan

[21] Appl. No.: 863,985

[22] Filed: Apr. 6, 1992

[30] Foreign Application Priority Data

Apr. 16, 1991 [JP] Japan ..... 3-084203

[51] Int. Cl.[5] ..... E02F 9/00

[52] U.S. Cl. ..... 414/686; 180/295; 180/312; 172/273

[58] Field of Search ..... 414/686, 694; 172/272-275; 280/756, 790; 296/187; 180/295, 312, 311, 900, 908

[56] References Cited

U.S. PATENT DOCUMENTS

| | | | |
|---|---|---|---|
| 3,733,103 | 5/1973 | Hansen | 280/756 X |
| 3,982,643 | 9/1976 | MacGregor et al. . | |
| 4,039,095 | 8/1977 | Lang | 414/694 |
| 4,264,264 | 4/1981 | McMillan et al. | 414/686 |
| 4,720,233 | 1/1988 | Meyer et al. . | |
| 4,737,067 | 4/1988 | Samejima et al. . | |
| 4,755,101 | 7/1988 | Hamada et al. . | |

FOREIGN PATENT DOCUMENTS

| | | |
|---|---|---|
| 0000281 | 1/1979 | European Pat. Off. . |
| 801141 | 9/1958 | United Kingdom . |
| 932839 | 7/1963 | United Kingdom . |
| 2178290 | 2/1987 | United Kingdom . |
| 2218891 | 11/1989 | United Kingdom . |

*Primary Examiner*—Michael S. Huppert
*Assistant Examiner*—Donald W. Underwood
*Attorney, Agent, or Firm*—Edwin E. Greigg; Ronald E. Greigg

[57] ABSTRACT

A frame structure of a working vehicle for attaching working implements includes front axle frames, side frames for attaching a front loader, and rear reinforcing members. The front axle frames extend forwardly and substantially parallel to each other on opposite sides of the working vehicle. The front axle frames are removably attached to an engine of the working vehicle. The side frames for attaching a front loader project laterally outwardly of the working vehicle for securing the front loader to distal ends thereof. The side frames are removably secured to the front axle frames through mounting plates, respectively. Each of the rear reinforcing members is supported at a forward end thereof by a bracket of one of the side frames, and at a rear end by a vehicle body. Each rear reinforcing member has a connector for supporting a safety frame.

8 Claims, 6 Drawing Sheets

FRAME STRUCTURE OF A WORKING VEHICLE FOR ATTACHING A WORKING IMPLEMENT

BACKGROUND OF THE INVENTION

1. Field of the Invention

The present invention relates to a frame structure of a working vehicle for attaching a working implement, and more particularly to an improvement in a frame structure for attaching a front loader and safety frames.

2. Description of the Related Art

Various inventions have heretofore been made in relation to frame structures of working vehicles for attaching working implements. In one known example, as disclosed in U.S. Pat. No. 4,755,101 to Hamada, frames extending parallel to each other substantially over an entire length of a vehicle body have arms for attaching a front loader. According to this structure, only forward portions of the frames are detachable from intermediate and rearward portions thereof. For maintenance of a transmission case, for example, the front loader attaching arms and the rearward portions of the frames must be removed also. This results in a maintenance operation or the like being intensely troublesome and time-consuming. Further, there have been no frame structures known heretofore that include couplings for supporting safety frames to provide protection for a driver's seat disposed in an upper rearward position of a tractor body. Couplings have to be additionally provided specially for supporting such safety frames.

SUMMARY OF THE INVENTION

The object of the present invention is to provide a frame structure for attaching a working implement which enables maintenance of a tractor body without removing the entire frame structure, which includes couplings for attaching safety frames and a front loader, and which is readily removable.

The above object is fulfilled, according to the present invention, by a frame structure for attaching working implements comprising front axle frames extending substantially parallel to each other on opposite sides of a vehicle body, side frames for attaching a front loader, the side frames being removably fixed to the front axle frames through intermediate mounting members, respectively, and rear reinforcing members each supported at a forward end thereof by a bracket of one of the side frames, and at a rear end by the vehicle body, each of the rear reinforcing members having a connector for supporting a safety frame.

According to the above structure, a maintenance operation may be carried out for a rear portion of the working vehicle simply by removing the rear reinforcing members. That is, a maintenance operation is possible without removing the front axle frames and side frames. The front axle frames, side frames and rear reinforcing members may be removed with ease since these components are connected to the vehicle body at a reduced number of positions. Moreover, the above structure includes safety frame connectors, thereby dispensing with special devices for supporting safety frames.

In a preferred embodiment of the invention, each rear enforcing member may include a connector for attaching a backhoe.

Other features and advantages of the present invention will be apparent from the following description of a preferred embodiment taken with reference to the drawings.

DETAILED DESCRIPTION OF THE PREFERRED EMBODIMENT

An embodiment of the present invention will be described with reference to the drawings.

Figure 1:
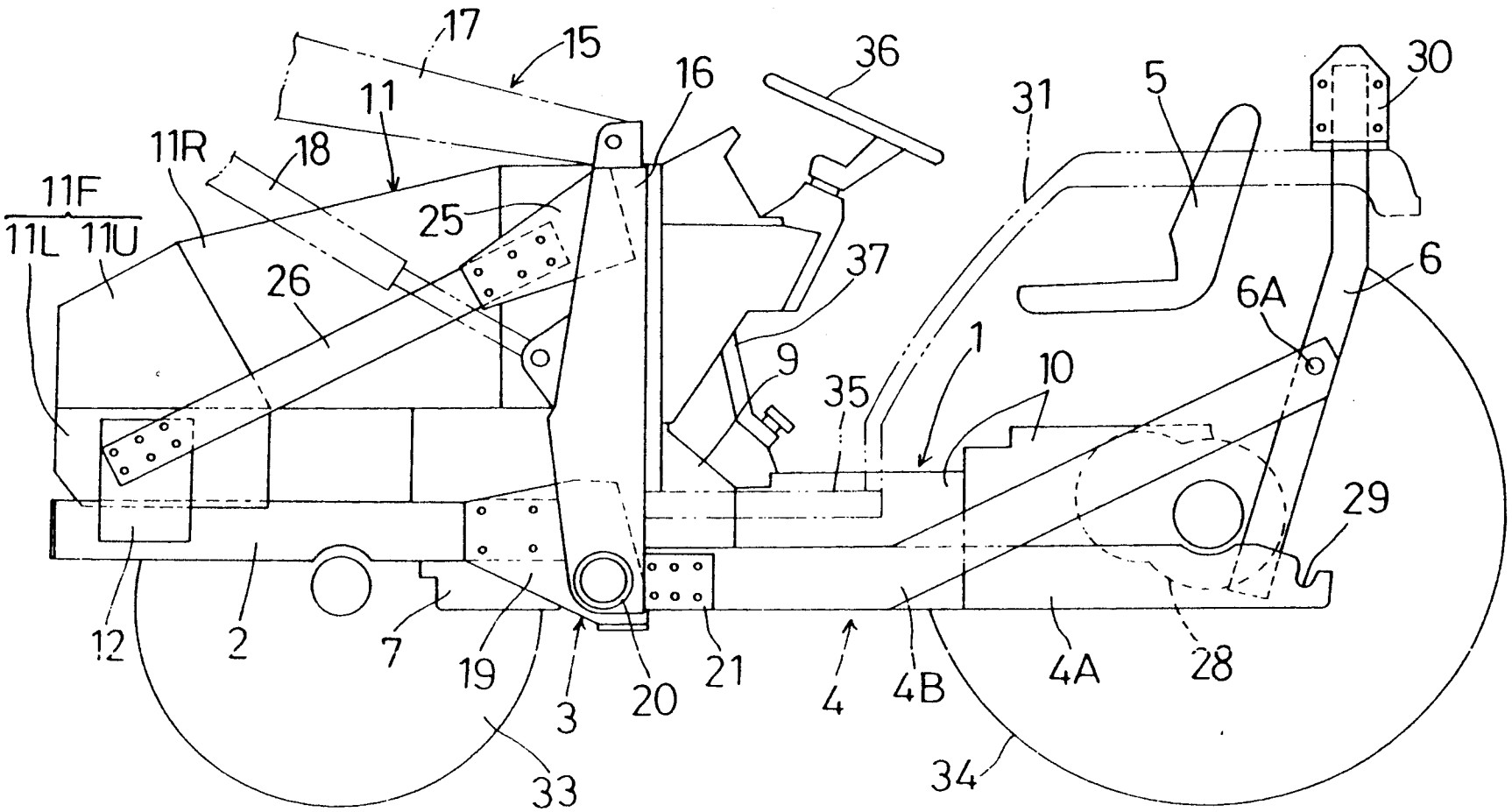
FIG. 1 is a side elevation of a tractor having a frame structure according to the present invention.
Figure 2:
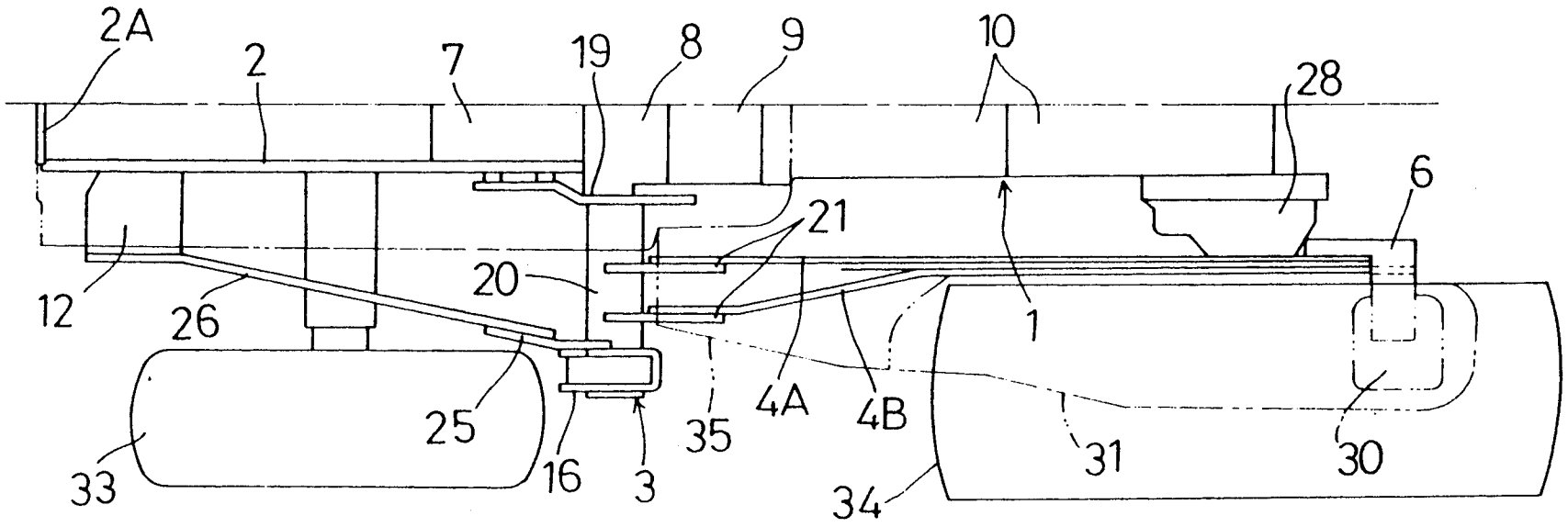
FIG. 2 is a top plan view of the left half of the 4 tractor.

Referring to FIGS. 1 and 2, a tractor 1 has an engine 7, a flywheel housing 8, a clutch housing 9 and a transmission case 10 arranged linearly in a fore and aft direction. The numeral 5 denotes a seat for an operator. In FIG. 1, numeral 33 denotes front wheels, numeral 34 rear wheels, numeral 35 steps, numeral 36 a steering wheel, and numeral 37 a clutch pedal.

Figure 3:
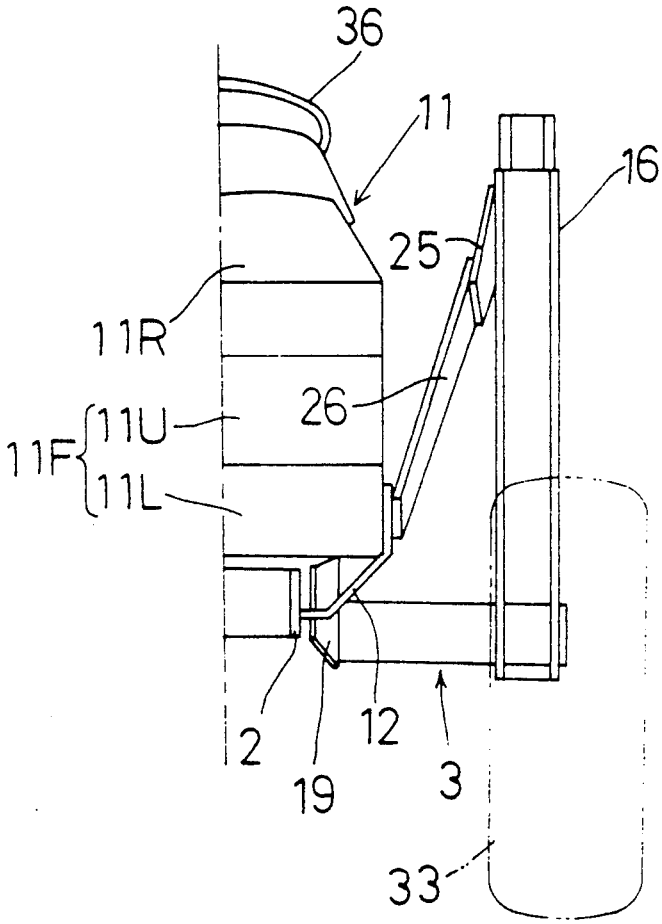
FIG. 3 is a front view of the left half of the tractor.

A front axle frame 2 is bolted to the engine 7 and extends forwardly therefrom. The front axle frame 2 includes a pair of plates extending parallel to each other in the fore and aft direction, and a cross member 2A extending transversely and interconnecting forward ends of the plates. Though not shown in the drawings, components such as a radiator and a battery are supported along with the engine 7 on the front axle frame 2. These components and the engine 7 are covered by a hood 11. The hood 11 includes a front hood 11F and a rear hood 11R. The front hood 11F includes an upper front hood 11U and a lower front hood 11L. As shown in FIG. 3, the lower front hood 11L is fixed to the front axle frame 2 and support elements 12 extending leftward and rightward therefrom. The upper front hood 11U is removably mounted on the lower front hood 11L and, in combination with the lower front hood 11L, supports a front grille not shown. The rear hood 11R is pivotally connected at a forward end thereof to the upper front hood 11U. The engine 7 and adjacent components can be accessed by raising a rear end of the rear hood 11R.

A portion of a front loader is shown at 15 in FIG. 1. Masts 16 support a boom 17 pivotally connected to upper ends thereof. The boom 17 in turn supports a bucket, not shown, pivotally connected to a distal end thereof. Numeral 18 denotes a hydraulic cylinder for vertically moving the boom 17. Though not shown, the front loader has a hydraulic cylinder for controlling the bucket. A bracket 25 is fixed to an upper position of each mast 16, and the bracket 25 and one of the support elements 12 are bolted to a brace 26 extending therebetween. Thus, each support element 12 acts also as an element for securing a forward end of the brace 26. Each mast 16 is secured to a side frame 3.

Figure 4:
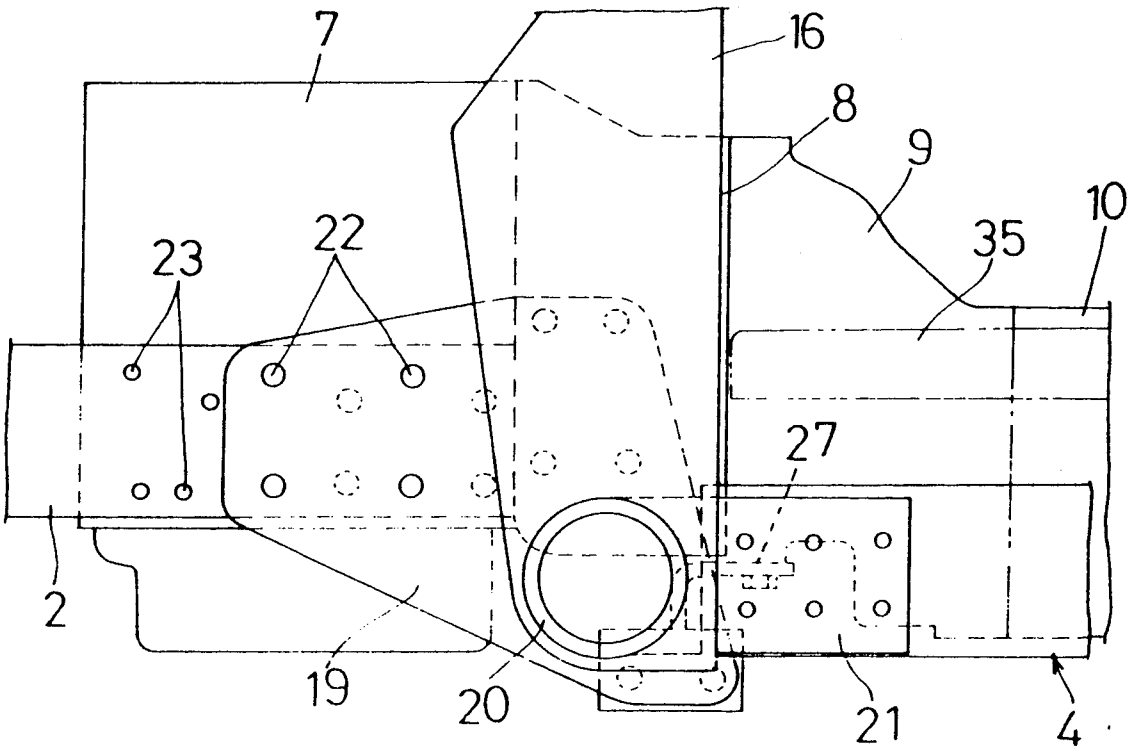
FIG. 4 is an enlarged view of a portion including a side frame and a mounting plate.
Figure 5:
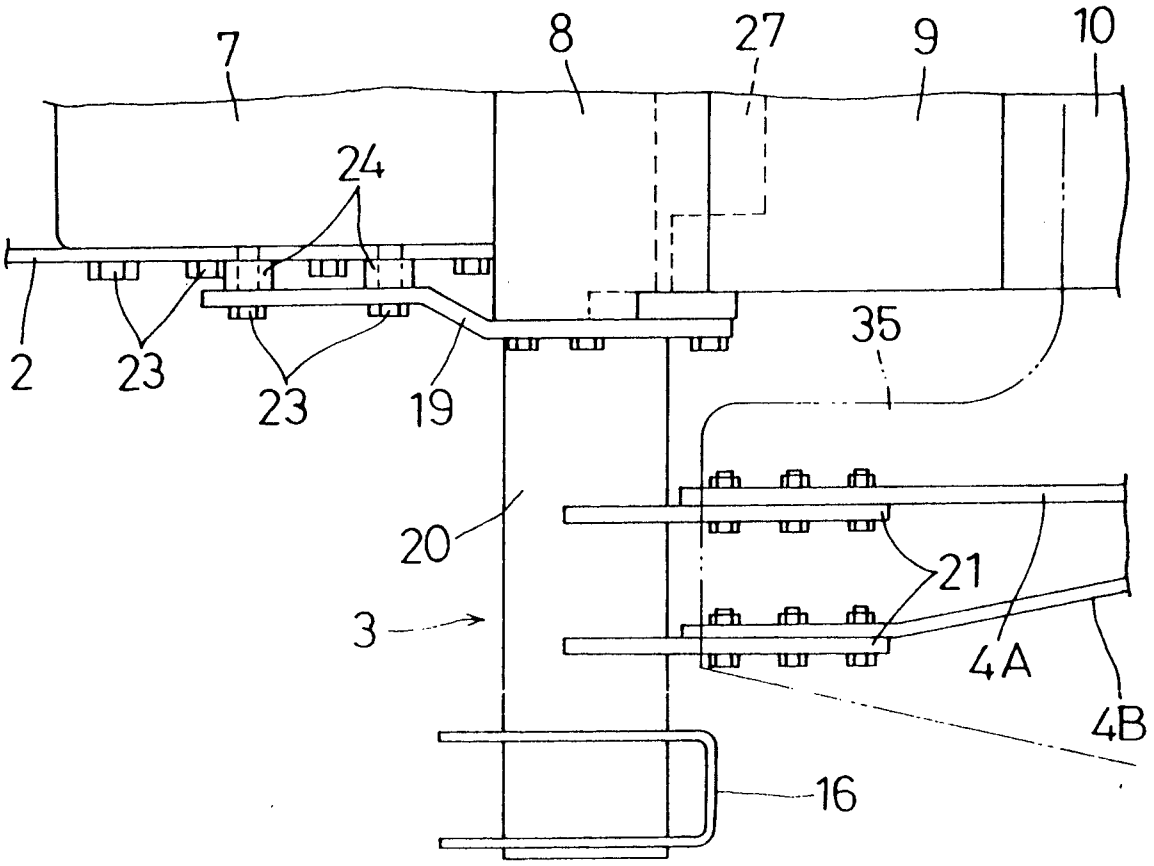
FIG. 5 is a top plan view of the portion shown in FIG. 4.

As shown in FIGS. 4 and 5, a mounting plate 19 has a forward portion thereof fixed to the front axle frame 2 by bolts 22. Spacers 24 are disposed between the mounting plate 19 and front axle frame 2, not to interfere with bolts 23 securing the front axle frame 2 to the engine 7. The mounting plate 19 has an upper rear portion thereof bolted to a side wall of the flywheel housing 8, and a lower rear portion bolted laterally of a reinforcing plate 27 bolted to a bottom wall of the clutch housing 9. The reinforcing plate 27 has a function to reinforce connection between the flywheel housing 8 and clutch housing 9. However, the reinforcing plate 27 must be removable for maintenance of a main clutch, and therefore may be attached to the flywheel housing 8 or may be omitted.

As best shown in FIG. 5, each of the side frames 3 provided laterally of the tractor 1 includes a tubular body 20 and a pair of brackets 21. The tubular body 20 is attached to the mounting plate 19 and projects outwardly from the tractor 1. The brackets 21 are spaced from each other transversely of the tractor 1 and fixedly extend rearwardly from the tubular body 20.

Each mast 16 is welded to the tubular body 20 to be inseparably connected thereto. This structure is selected so that the tractor is used exclusively for the front loader. For an all-purpose tractor, each side frame 3 may include a mast socket fixed thereto for removably supporting the mast.

Forward ends of two plate-like rear reinforcing frames 4 are bolted to the two brackets 21, respectively. A first rear reinforcing frame 4A extends straight rearwardly to be bolted at a rear end portion thereof to a brake case 28 fixed to the transmission case 10. The first rear reinforcing frame 4A has a recess 29 formed at a rear end thereof for engaging and supporting a lower position of a backhoe mount. A lower end of a safety frame 6 is fixed to a position immediately forwardly of the recess 29 of the first rear reinforcing frame 4A.

Figure 6:
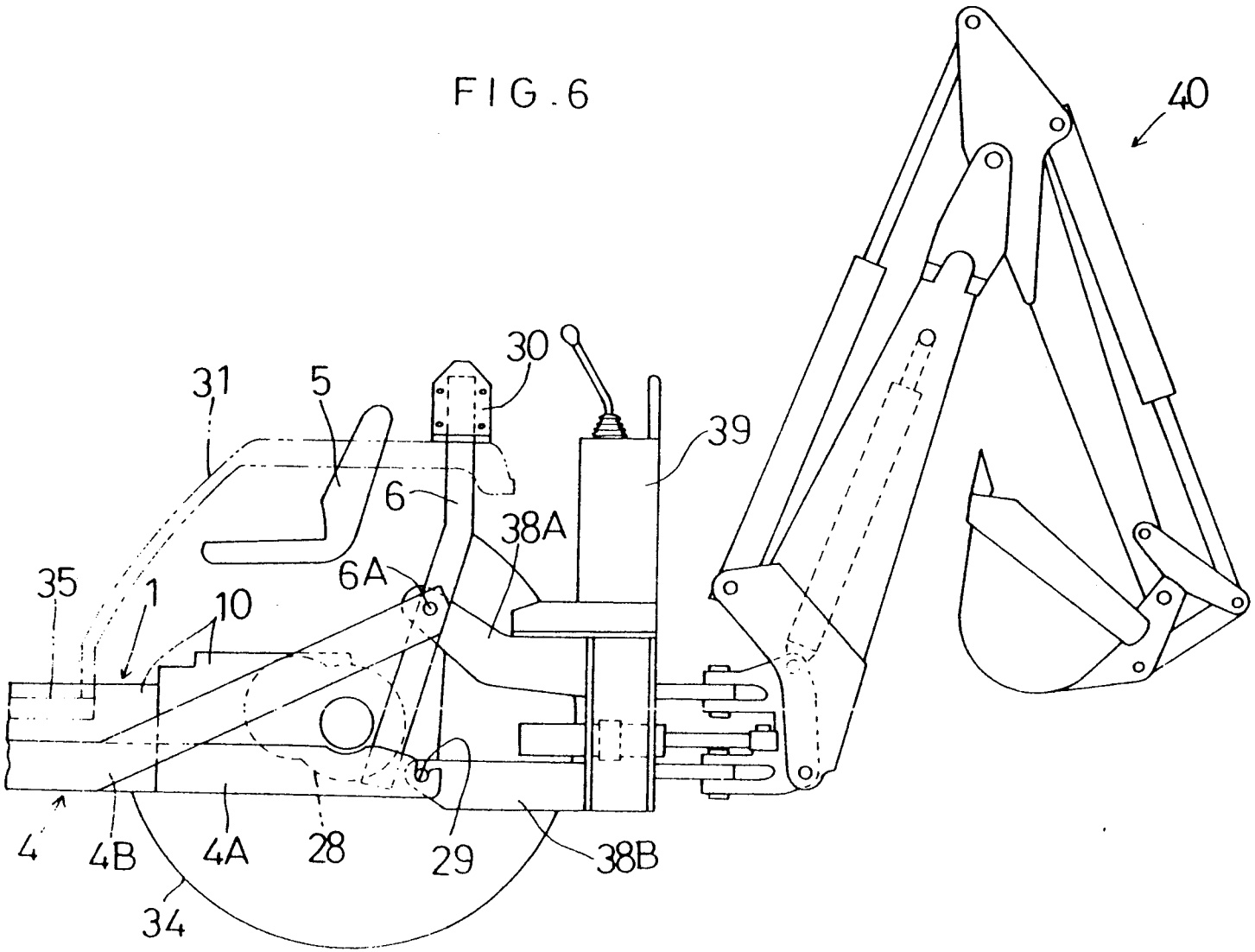
FIG. 6 is a side view of a backhoe attaching section.

As shown in FIG. 1, the second rear reinforcing frame 4B is horizontally coextensive to an intermediate position with the first rear reinforcing frame 4A, and then extends upwardly from that position rearward. As shown in FIG. 2, the reinforcing frame 4B supported by one of the brackets 21 as spaced from the reinforcing frame 4A extends rearwardly toward the reinforcing frame 4A until it meets the latter, and from the meeting point rearward the two reinforcing frames 4A and 4B extend alongside each other as seen from above. Preferably, a fixed connection point is provided between the first reinforcing frame 4A and second reinforcing frame 4B. The second reinforcing frame 4B has a rear end thereof connected to the safety frame 6 at a connection 6A slightly above the lower end thereof. An upper end of the safety frame 6 is connected to a rear fender 31 through a connector 30. An upper safety frame not shown is connected to the safety frame 6. As shown in FIG. 6, a mount 39 of a backhoe 40 includes an upper coupling 38A connected to the connection 6A between the second rear reinforcing frame 4B and safety frame 6, and a lower coupling 38B connected to the recess 29 of the first rear reinforcing frame 4A.

The present invention is not limited to the foregoing embodiment but may be modified in various ways. For example, each side frame 3 may be connected only to the front axle frame 2 without being connected to the flywheel housing 8. The reinforcing frames 4 on each side of the tractor may be integrated into a single plate or may be formed of pipes.

What is claimed is:

1. An apparatus for attaching working implements such as a bucket loader and a backhoe to a tractor having a tractor body formed of an engine, a clutch housing and a transmission case rigidly connected to one another, said apparatus comprising:

a pair of front frames disposed on opposite sides and extending forwardly of said tractor body, said front frames having rear ends thereof fixed to said engine, respectively;

a cross member for interconnecting forward ends of said front frames;

relay brackets each having one end removably fixed to one of said front frames, and the other end removably fixed to said tractor body;

side frames extending from said relay brackets laterally outwardly of said vehicle body, respectively, each of said side frames having an implement connector at an outward end thereof, and including a first and a second brackets spaced from each other in a direction in which each of said side frames extends;

rear frames each having a forward end removably fixed to said first bracket and a rear end removably fixed to a rear position of said tractor body, each of said rear frames extending substantially straight and including an implement connector in a rear end region thereof; and auxiliary rear frames each having a forward end removably fixed to said second bracket, each of said auxiliary rear frames being curved upward and including an implement connector in a rear end region thereof;

whereby said implement connector of each of said rear frames and said implement connector of each of said auxiliary rear frames provide two attaching positions at different heights for connection to a working implement.

2. A frame structure of a working vehicle for attaching working implements comprising:

front frames that extend substantially parallel to each other in a fore and aft direction of a vehicle body;

relay brackets;

side frames for attaching a front loader, said side frames projecting laterally of said vehicle body and being removably attached to and rearwardly of said front frames through said relay brackets;

a first bracket provided on each of said side frames;

plate-like rear frames removably supported at a forward position thereof by said first brackets and at a rearward position by said vehicle body;

a second bracket provided on each of said side frames;

plate-like auxiliary rear frames extending rearwardly of said vehicle body and removably supported by said second bracket; and safety frames removably supported by at least one of said rear frames and auxiliary rear frames.

3. A frame structure as claimed in claim 2, wherein said first bracket and said second bracket are spaced from each other transversely of said vehicle body.

4. A frame structure as claimed in claim 3, wherein each of said rear frames extends substantially straight from one of said side frames to a rear end region of said vehicle body, and includes a first connector for supporting a lower end of one of said safety frames.

5. A frame structure as claimed in claim 4, wherein each of said auxiliary rear frames includes a first portion extending substantially horizontally and rearwardly from one of said side frames and a second portion formed integral with said first portion and extending upwardly and rearwardly therefrom, said second portion having a second connector for supporting a position of said one of said safety frames above said lower end thereof.

6. A frame structure as claimed in claim 2, wherein each of said rear frames and each of said auxiliary rear frames include connecting positions in a rear region thereof for attaching a backhoe.

7. A frame structure as claimed in claim 6, wherein said connecting positions on said rear frames is a recess and the connecting positions on said auxiliary rear frames is a second connector.

8. A frame structure as claimed in claim 2, wherein each of said brackets is formed of a single plate having a forward portion thereof removably attached to one of said front frames, and a rearward portion supporting one of said side frames.

* * * * *